US011365518B2

(12) United States Patent
Hardacre et al.

(10) Patent No.: US 11,365,518 B2
(45) Date of Patent: Jun. 21, 2022

(54) MOULDING OF ARTICLES

(71) Applicant: NATURAL RESOURCES (2000) LIMITED, Apsley (GB)

(72) Inventors: Anthony Hardacre, Bath (GB); Alan Smith, Stoke-on-Trent (GB)

(73) Assignee: Natural Resources (2000) Limited, Hemel Hempstead (GB)

( * ) Notice: Subject to any disclaimer, the term of this patent is extended or adjusted under 35 U.S.C. 154(b) by 0 days.

(21) Appl. No.: 16/320,939

(22) PCT Filed: Jul. 20, 2017

(86) PCT No.: PCT/GB2017/052138
§ 371 (c)(1),
(2) Date: Jan. 25, 2019

(87) PCT Pub. No.: WO2018/020219
PCT Pub. Date: Feb. 1, 2018

(65) Prior Publication Data

US 2019/0169800 A1 Jun. 6, 2019

(30) Foreign Application Priority Data

Jul. 26, 2016 (GB) ..... 1612889

(51) Int. Cl.
*D21J 3/10* (2006.01)
*D21J 7/00* (2006.01)
*D21F 5/16* (2006.01)

(52) U.S. Cl.
CPC ..... *D21J 3/10* (2013.01); *D21F 5/167* (2013.01); *D21J 7/00* (2013.01)

(58) Field of Classification Search
CPC ..... D21J 3/10; D21J 7/00; D21F 5/167
See application file for complete search history.

(56) References Cited

U.S. PATENT DOCUMENTS 5,453,159 A * 9/1995 Markham ..... D21B 1/345 162/4
6,103,179 A 8/2000 Larsson
(Continued)

FOREIGN PATENT DOCUMENTS

DE 4404322 A1 8/1995
EP 1195466 A1 4/2002
(Continued)

OTHER PUBLICATIONS

Osong et al, Processing of wood-based microfibrillated cellulose and nanofibrillated cellulose, and applications relating to papermaking: a review, Springer Science+Business, Oct. 27, 2015 (Year: 2015).*

(Continued)

*Primary Examiner* — Jacob T Minskey
*Assistant Examiner* — Elisa H Vera
(74) *Attorney, Agent, or Firm* — Merchant & Gould P.C.

(57) ABSTRACT

A method of forming a molded article includes preparing a fiber suspension by liquidizing fibrous material in a suspending liquid using at least one high shear mixer. The fiber suspension is fed to the molding surface of a porous mold. The suspending liquid is removed via the pores of the porous mold to deposit suspended fibers on the mold surface as a molded article. Removing the suspending liquid is achieved by pressing a bladder formed of a flexible impermeable membrane against the article using pressure applied behind the membrane. The molded article is removed from the porous mold dried using microwave radiation generated using at least one magnetron. A molding apparatus is use in the method and a molded article is produced by the method.

15 Claims, 14 Drawing Sheets

(56) References Cited

U.S. PATENT DOCUMENTS

| | | | | |
|---|---|---|---|---|
| 2003/0209337 | A1* | 11/2003 | Nonomura | D21J 3/10 162/218 |
| 2009/0139678 | A1* | 6/2009 | Nilsson | D21J 3/00 162/383 |
| 2010/0207300 | A1* | 8/2010 | Johnson | D21J 3/00 264/442 |
| 2011/0081225 | A1* | 4/2011 | Ward | A22C 17/0033 414/789.5 |
| 2011/0259537 | A1* | 10/2011 | Husband | D21C 9/001 162/4 |
| 2013/0012598 | A1* | 1/2013 | Velev | D01D 5/40 514/772.4 |
| 2015/0158955 | A1* | 6/2015 | Graveson | D21C 9/005 162/76 |
| 2016/0024718 | A1* | 1/2016 | Lee | D21H 11/18 162/9 |
| 2016/0230348 | A1 | 8/2016 | Massouda | |
| 2017/0305232 | A1* | 10/2017 | Vorenkamp | D21J 7/00 |
| 2017/0333259 | A1* | 11/2017 | Trennepohl | A61F 13/2088 |

FOREIGN PATENT DOCUMENTS

| | | | |
|---|---|---|---|
| KR | 2002-0028926 | A | 4/2002 |
| WO | 2009/034334 | A1 | 3/2009 |
| WO | 2009/034344 | A2 | 3/2009 |
| WO | 2011/157999 | A2 | 12/2011 |
| WO | 2012/139590 | A1 | 10/2012 |

OTHER PUBLICATIONS

International Search Report and Written Opinion for International Application No. PCT/GB2017/052138, dated Nov. 9, 2017.

* cited by examiner

A

B

MOULDING OF ARTICLES

This application is a National Stage Application of International Application No. PCT/GB2017/052138, filed 20 Jul. 2017, which claims benefit of Serial No. 1612889.4, filed 26 Jul. 2016 in the United Kingdom and which applications are incorporated herein by reference. To the extent appropriate, a claim of priority is made to each of the above disclosed applications.

The present invention relates to a method of forming a moulded article; a moulding apparatus; and a moulded article.

Items moulded from paper fibre pulp have in the past generally been items such as egg boxes and bed pans which can be produced in very large numbers, are unsophisticated in shape and do not require any very high standard of surface finish. These limitations have been imposed by the technology employed in the moulding of the articles which traditionally have been moulded using permeable moulds formed of metal mesh. The construction of such a mould is a lengthy and expensive procedure limiting this technology to items to be produced in very substantial numbers. The quantity of liquid which can be expelled from the deposited paper fibres in the mould prior to demoulding is limited by the poor level of surface smoothness obtained using such mesh moulds and this in turn limits the strength of the product as it is demoulded. Because of this, only shallow items such as egg boxes can be made this way without collapsing under their own weight prior to drying. The amount of water left in the product makes drying the product an energy intensive procedure.

The hydropulper which is used to prepare paper fibre pulp in a conventional moulding process is a large cylindrical shaped chamber which can measure up to 8 metres diameter×4-5 metres deep, having a large two blade rotor which slowly rotates (e.g. at 200-500 rpm) at its base. This breaks down sheet paper or board into pulp moulding stock. The material is separated into individual fibres with the aid of water to a determined viscosity, typically 5 parts paper to 95 parts water in conventional paper making. This takes approximately 10-15 minutes to achieve before the pulp furnish is suitable for processing through a "de-flaker", a device used to further refine the pulp fibre furnish, and then for vacuum forming onto mesh moulds. A device of large physical size is needed to be able to process large volumes of paper by allowing the speed and movement of the rotor to break down the solid paper mass as it stirs and rubs against itself, breaking it into individual pulp fibres.

WO2009/034344 of the applicant discloses a moulding machine for paper fibre articles with a mould made from bonded particles. Liquidised pulp may be prepared using a liquidiser. Liquid from a measured shot of pulp is drawn through the mould using a piston on the other side. The article is dewatered with a rubber former/flexible membrane. The article is dried in the mould using pressurised hot air.

EP1195466 discloses a method for producing a pulp molded article including the steps of forming and drying a pulp molded precursor. A mould with interconnecting holes to allow water egress is used and is covered with a mesh net on which the pulp is deposited. The mould is dewatered by vacuum and then an inflatable member is expanded inside the cavity to press against the paper fibre, forming it as required. The drying step includes a first step of hot-pressing in a cavity of a heating mould and a second step of heat-drying in a drying furnace.

U.S. Pat. No. 6,103,179 discloses a method and an arrangement for manufacturing a fibre product using complementary male and female moulds. Water is expressed by pressure between the moulds. The fibre product is released and subjected to final drying under the effect of microwave or IR radiation.

WO2011/157999 discloses a method and apparatus for moulding an article from pulp material in which the article is moulded on the surface of a mould tool and the pressed article is dried using heated gas or superheated steam that is passed through the pressed article, or using microwaves. The pressed article is retained on a tool (which may be the mould tool or a different tool) during drying.

KR2002-0028926 discloses a method for producing a pulp mold molded container comprising forming a pulp layer as a wet molded body of pulp slurry; coating a composite resin suspension on the surface of the pulp mold formed body and drying with a microwave; melting the obtained coat; and blow molding the pulp mold formed body into a preform and presetting. Water may be eliminated from the pulp using a balloon/bag shape of elastic material.

In a first aspect, the invention relates to a method of forming a moulded article comprising:

- preparing a fibre suspension by liquidising fibrous material in a suspending liquid using at least one high shear mixer;
- feeding the fibre suspension to the moulding surface of a porous mould; removing said suspending liquid via the pores of said porous mould to deposit suspended fibres on said mould surface as a moulded article, the step of removing said suspending liquid comprising pressing a bladder formed of a resilient flexible impermeable membrane against the article using pressure applied behind the membrane;
- removing the moulded article from the porous mould; and
- drying the moulded article using microwave radiation generated using at least one magnetron.

Preferably, the moulded article is a three-dimensional hollow form. This term includes a hollow three-dimensional shape having a limited opening and overhanging parts such that a rigid moulded article of the shape cannot be defined on all surfaces between two rigid mould parts whilst allowing the moulded article to be removed from the mould parts. Three-dimensional hollow forms are thus analogous to articles which can be produced by blow moulding but not by simple injection moulding. Such shapes have an inside surface and an outside surface. This is in contrast to the egg boxes and bed pans conventionally moulded from paper fibre and referred to above: egg boxes and bed pans have wide openings with draft angles which permit moulding between rigid mould parts whilst allowing the moulded article to be removed from the mould parts.

More preferably, the article is a bottle including a body and a narrower neck having an opening. Examples of suitable bottle capacities are 100 mL to 2 L e.g. 200 mL, 250 mL or 1 L.

Preferably, the process is automated. Preferably multiple moulds are operated simultaneously. Preferably the process is continuous but a batch process is also possible; alternatively, some steps of the process may be continuous but others may be conducted in batches.

The fibrous material used as feedstock for the process suitably comprises cellulose fibre e.g. paper fibre but may alternatively or additionally comprise other natural or non-natural materials. Virgin or recycled paper or card (e.g. newsprint, glossy magazines, corrugated cardboard, office waste paper) are suitable types of paper fibre. Bamboo and flax may also be used.

The preferred suspending liquid is water.

Preferably, the concentration of fibrous material in the suspending liquid is in the range of 0.5-10 wt % of paper fibre in water. At higher fibre contents the suspension's flow characteristics may be affected such that it becomes difficult to transport the suspension and to achieve an even coating on the mould. In a preferred embodiment, the concentration of fibrous material in the suspending liquid is about 1%.

Additives may be used to modify the mechanical and other characteristics of the product. These include mechanical strength, surface finish, degrees of waterproofing and food barrier properties such as transmission of oxygen and other gases. The additive may for example comprise colouring or herbicide or germicide or fungicide or beeswax or decorative particles, or a combination thereof. Preferably, the additive amount is no more than 20 wt % of the solids content. In some preferred embodiments, no additives are present.

The present invention makes use of at least one high shear mixer rather than a conventional hydropulper as described above. The benefits of this are threefold. The mixer equipment is typically much smaller than many batch hydropulpers conventionally employed, allowing reduced overall apparatus size. The pulping process is fast (e.g. with a residence time of 15-30 minutes), thereby limiting the period in which fibres can hydrate in the suspending liquid and making it easier to dewater. Finally the mixer can be operated in inline mode, allowing a continuous process and eliminating the need for large storage vessels at the head end of the process, again allowing reduced overall apparatus size.

Preferably, the or each high shear mixer comprises one or more rotors rotating at 1000-4000 rpm, for example at about 3000 rpm. This is preferred to higher rotational speeds (e.g. above 5000 rpm) which the inventors have found can potentially cause clumping or destruction of fibres. More preferably, the or each high shear mixer further comprises a stator, and the rotors rotate within the stator. The term "stator" includes a perforated non-rotating element surrounding the rotor(s) e.g. of a generally circular cylindrical shape. Suitably the stator is of smaller diameter than the outer walls of the high shear mixer. The stator may for example have circular holes, slots or square holes. A slotted head liquidiser is described in WO2009/034344 mentioned above.

Preferably, the fibre suspension is prepared in two stages using a first high shear mixer followed by a second high shear mixer (which is suitably of smaller capacity than the first high shear mixer). The two-stage process has been found by the inventors to impart consistent particle size reduction, which can be seen by microscopic examination.

Preferred fibre lengths are in the range of 0.75-1.8 mm e.g. with a mean fibre length of about 1.3 mm.

The mixers may be contained in a subunit, which may suitably be 0.5 to 1 m in length.

Preferably the porous mould is in at least two separable parts which preferably co-operate to define the outside surface of the moulded article during the moulding step and then separate to release the moulded article. Each mould may define two or more moulded articles e.g. 4-6 articles; a mould defining 2 or more articles is also referred to herein as a "mould block".

Preferably, the porous mould has pores of diameter in the range of 0.3-0.6 mm. Smaller pores could become blocked or prevent efficient removal of suspending liquid; larger pores could produce an undesirably rough surface finish on the moulded article.

Preferably, the porous mould has a thickness of 1-10 mm e.g. 4-8 mm.

Possible materials for a porous mould include metal, plastics and ceramic.

Preferably the porous mould is formed partially or completely of bonded particles. The particles are preferably spherical. A mould of bonded particles typically provides an even arrangement of pores which as explained below helps to provide an even coating of fibres on the mould surface.

The bonded particles may be bonded by adhesive or sintered together. The bonded particles may be of glass, plastics or metal. Preferred metal materials are phosphor-bronze and nickel coated copper. The particle size (diameter) for the particles of the mould is preferably between 0.1 and 1.0 mm.

Alternatively the porous mould may not be formed of bonded particles. In this case, the porous mould may be formed using an additive manufacturing technique (also referred to as "three-dimensional printing"), for example a laser-based additive manufacturing technique which uses a laser to melt layers of metal powder sequentially to form the required shape. Three-dimensional elements down to a size of 40 μm can be produced. Suitable metal powders for additive manufacturing include tool steel, stainless steel 316, titanium and inconel.

High engineering accuracy is possible in mould production. If an embossed logo or other finely defined surface feature (e.g. imitation wood or leather grain) is required on the finished product, this can be provided on the internal surface of the mould.

The suspending liquid may be forced through the mould by applying a pressure difference across the mould.

The porous mould is preferably charged by positive pressure e.g. under gravity. The charging means may include means for dispensing an accurate quantity of fibre suspension e.g. a volumetric cylinder or weight sensor. This is particularly useful in the formation of small and/or lightweight packages.

Preferably, the suspending liquid is also removed via the pores of the porous mould using suction (also referred to herein as "vacuum"). The suction is preferably applied such that the suspended fibres are deposited evenly on the mould surface. An even coating of fibres is generally formed if the ventilation of the mould with pores is even over the mould. The suction may be applied though the action of a piston in a chamber closed off by the mould.

The method may comprise passing a backwash liquid through the mould in the opposite direction from that in which the suspending liquid passed through the mould. The method may comprise introducing ultrasound into the backwash water passing through the mould.

Materials for the further treatment of the article in its wet state may be passed through the porous mould either from the interior of the mould to the exterior or in the opposite direction as a backwash.

Suitably, the moulded article contains around 75% water by weight at this stage.

Further suspending liquid is removed (also referred to herein as "dewatering") by pressing a bladder formed of a flexible impermeable membrane against the article using pressure applied behind the membrane. The membrane is preferably resilient/elastically deformable.

As will be appreciated, where a mould block is designed to mould multiple articles simultaneously, a separate bladder is suitably provided for each article.

The uninflated bladder is preferably inserted through the opening of a three-dimensional hollow form article within the porous mould so that the bladder is positioned at least partially inside the article (e.g. within the body and neck of a bottle). The bladder is then inflated to apply pressure to the inside surface of the article. The membrane of the inflated bladder expands as a result of its resilience. Preferably, the inflated bladder contacts the entire inside surface of the article. Profiling (i.e. shaping) of the bladder is beneficial to ensure uniform internal conformity to the mould. The bladder membrane is shaped to match the inside profile of the product being manufactured, and is used both as a forming aid and for removing suspending liquid.

Suitable liquid and air resistant materials for the bladder include natural rubber or synthetic rubber. Suitably the thickness of the bladder is in the range of 0.5-1.5 mm.

The bladder may suitably be inflated hydraulically or pneumatically. Pneumatic inflation is preferred. Appropriately balanced pressure is used to avoid opening of the mould during this step. Compressed air at a pressure in the range of 1 to 10 bar (100 kPa to 1 MPa) gauge is preferred. Pressure oscillation may be used.

This mechanical dewatering step expels suspending liquid quickly and easily which saves energy in the next drying phase. At this stage the water content of the article is typically 70-80%. The bladder can be used to provide a smooth or desirably textured surface (preferably an inside surface of an three-dimensional hollow form) of the moulded article.

Drying may take place after removing the bladder and before removing the article from the porous mould but this is not preferred. Preferably, no active drying takes place in the porous mould (other than the dewatering discussed above).

Preferably, during the step of removing the moulded article from the porous mould the moulded article remains supported by the bladder. The moulded article form at this stage is very fragile and the bladder pressure should be carefully controlled to achieve mould release without distortion or damage. This early release from the mould has a benefit over many existing processes in that the moulded article need not be dried in the mould. This allows energy to be saved that would otherwise be used to dry the mould, which is reimmersed in suspending liquid during the next process cycle as described below.

The bladder is preferably used to transport the moulded article for drying.

Preferably, the moulded article is removed from the bladder before drying. The membrane of the deflated bladder contracts to its original size as a result of its resilience. The pressurising fluid is suitably evacuated to achieve this.

Preferably, no hot air or infra-red radiation is used in drying the moulded article.

Drying preferably takes place within a microwave drying chamber. Suitably, the moulded article is placed onto a conveyor belt which conveys the moulded article through the microwave drying chamber in batches. The conveyor belt may be permeable (e.g. a lattice belt) to assist evaporation of suspending liquid.

Preferably, the moulded article is exposed to multiple microwave sources (magnetrons) for drying. The magnetrons may be mounted to the upper wall of the microwave drying chamber. Microwave energy is focused upon the suspending liquid contained in the moulded article, so that energy is not wasted in heating the surrounding air or equipment. The magnetrons preferably have a frequency of 2.45 GHz (the resonant frequency of water).

The use of an array of domestic grade magnetrons allows a cost saving compared with industrial grade magnetrons. Preferably each magnetron operates at a power rating less than 5 kW, more preferably less than 1 kW e.g. 600-900 W. A maximum power rating of 900 W is particularly suitable. Preferably, at least 10 magnetrons are used e.g. 60 magnetrons. The preferred total power rating is in the range of 5-60 kW.

Magnetron antennae may be used to direct the radiation field into the drying chamber, so that it is not necessary to use separate wave guides in the conventional way.

The positions and operating powers of the magnetrons may be chosen to achieve optimum spacing of the magnetrons whilst maximising use of the radiation field.

The magnetrons are preferably arranged in an array.

The moulded articles are preferably arranged in a complementary array. As an example, the magnetrons and/or moulded articles may be evenly spaced in a rectangular or hexagonal grid arrangement.

Preferably, each magnetron is individually controllable for power and/or frequency such that the power output can be controlled for individual magnetrons or for the group of magnetrons. Preferably, different magnetrons of the array are operated at different powers, and the powers are preferably determined in accordance with the weight of water and product. Power profiling can take the form of percentage reduction in power application to the antennae and/or reduction in energisation time.

In preferred embodiments, the power output is low (e.g. 0-25% of maximum power) at the beginning and end of the drying process (corresponding to the end positions of a tunnel/conveyor arrangement) and peaks (e.g. at 50-100% of maximum power) at the middle of the drying process (corresponding to the mid-point of a tunnel/conveyor arrangement).

Preferably, airflow is maintained through the chamber in order to extract evaporated suspending liquid, and to ensure that the magnetrons are kept suitably cool.

Preferably, a system of airlocks is used in the microwave drying chamber. Suitably there are loading and unloading airlocks. Each airlock preferably includes two doors. Suitably, pneumatically operated doors operate in synchronisation at each airlock so that both doors of the airlock are never open at once. This allows continuous operation while ensuring no leakage of microwave energy outside the unit.

The method may further include features described in WO2009/034334.

In a second aspect, the invention relates to a moulding apparatus for use in a process as described above, comprising:

- a porous mould;
- at least one high shear mixer connected to supply a fibre suspension to a moulding surface of the mould;
- a bladder formed of a resilient flexible impermeable membrane advanceable into the moulding surface; and
- a magnetron which is a source of microwave radiation.

The moulding apparatus may comprise a plurality of moulds or mould blocks which are moveable between different work stations for different stages of the process (e.g. feeding the fibre suspension to the moulding surface; removing the suspending liquid and pressing a bladder against the article; removing the moulded article from the mould). The moulds or mould blocks may for example be mounted on a turntable which rotates them between the different work stations.

As with the method, the moulding apparatus may include features described in WO2009/034334, for example some or all of:

- a cavity for receiving the porous mould;
- a port for feeding a suspension of fibres to a moulding surface of the porous mould;
- a port or piston for applying suction to the other surface of the mould;
- a port for supplying backwash water into the cavity;
- a port for supplying compressed air.

In a third aspect, the invention provides a moulded article formed by the method described above.

Features described in connection with one aspect of the invention may be used with any other aspect of the invention.

The invention will be further described and illustrated with reference to the accompanying drawings in which.

Figure 1:
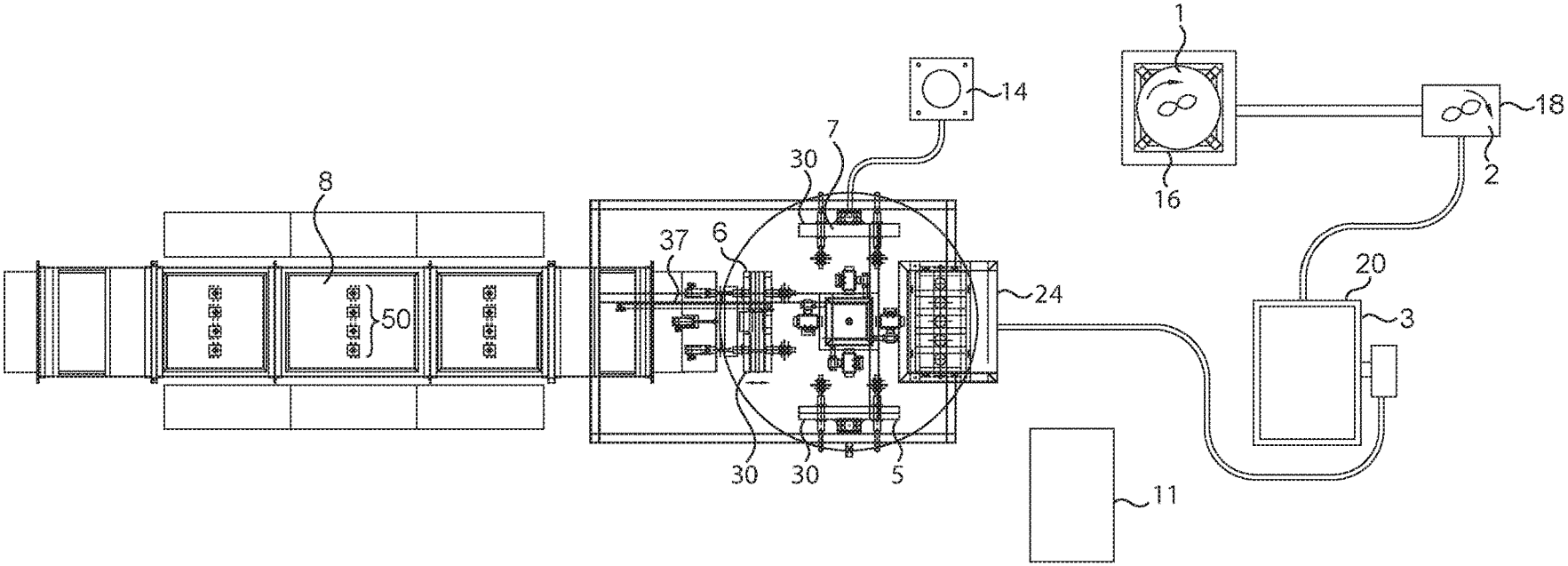
FIG. 1 shows a plan view of the moulding apparatus of a preferred embodiment of the invention.
Figure 6:
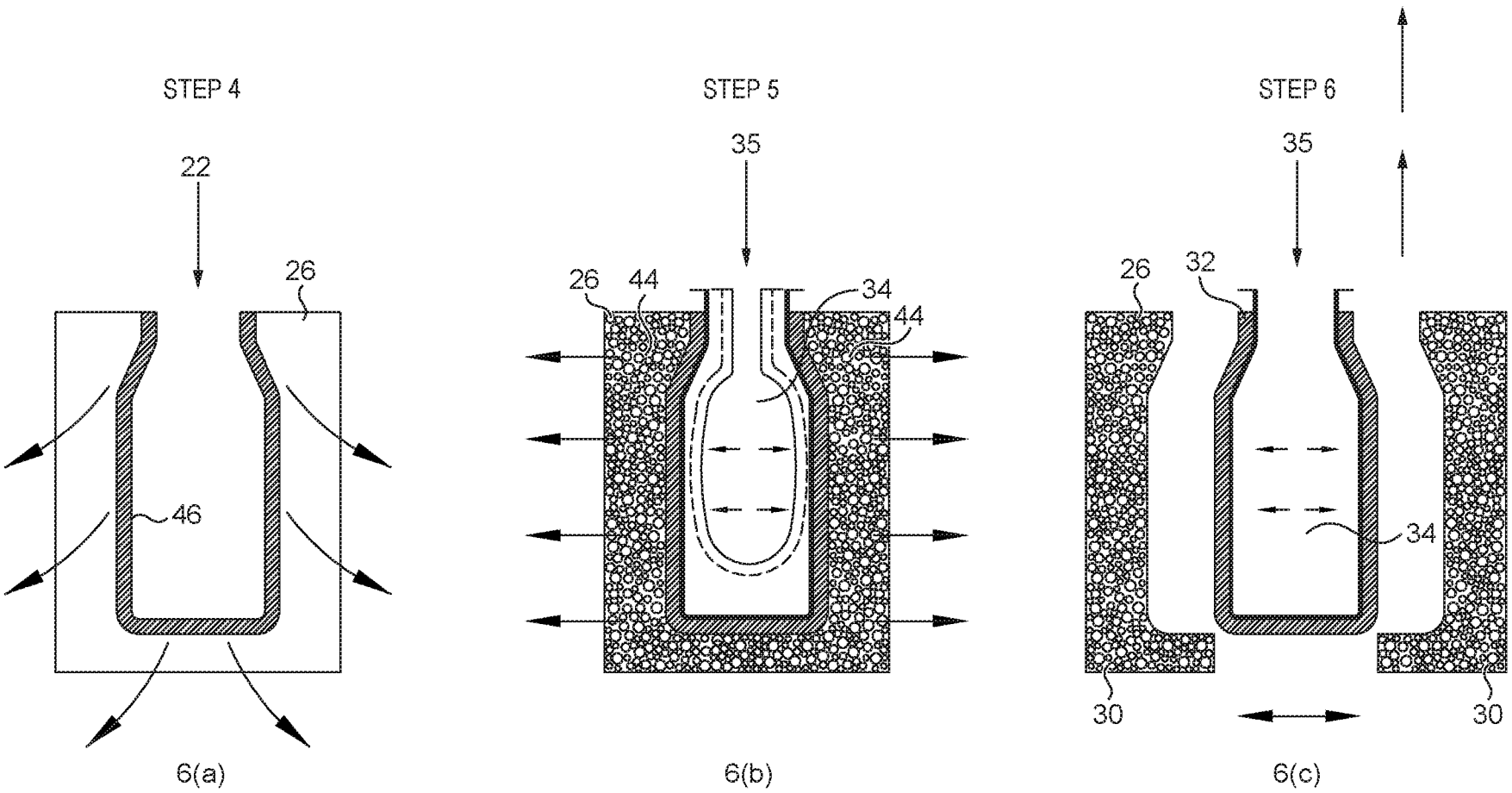

FIG. 6 shows cross-sectional schematic views of the mould during various steps of the process using the moulding apparatus of FIG. 1: FIG. 6(*a*) shows the steps of feeding the fibre suspension to the moulding surface of the mould and removing the suspending liquid via the pores of the mould to deposit suspended fibres as a moulded article; FIG. 6(*b*) shows the step of removing suspending liquid by pressing a bladder against the article; FIG. 6(*c*) shows removing the moulded article from the mould.

Figure 7:
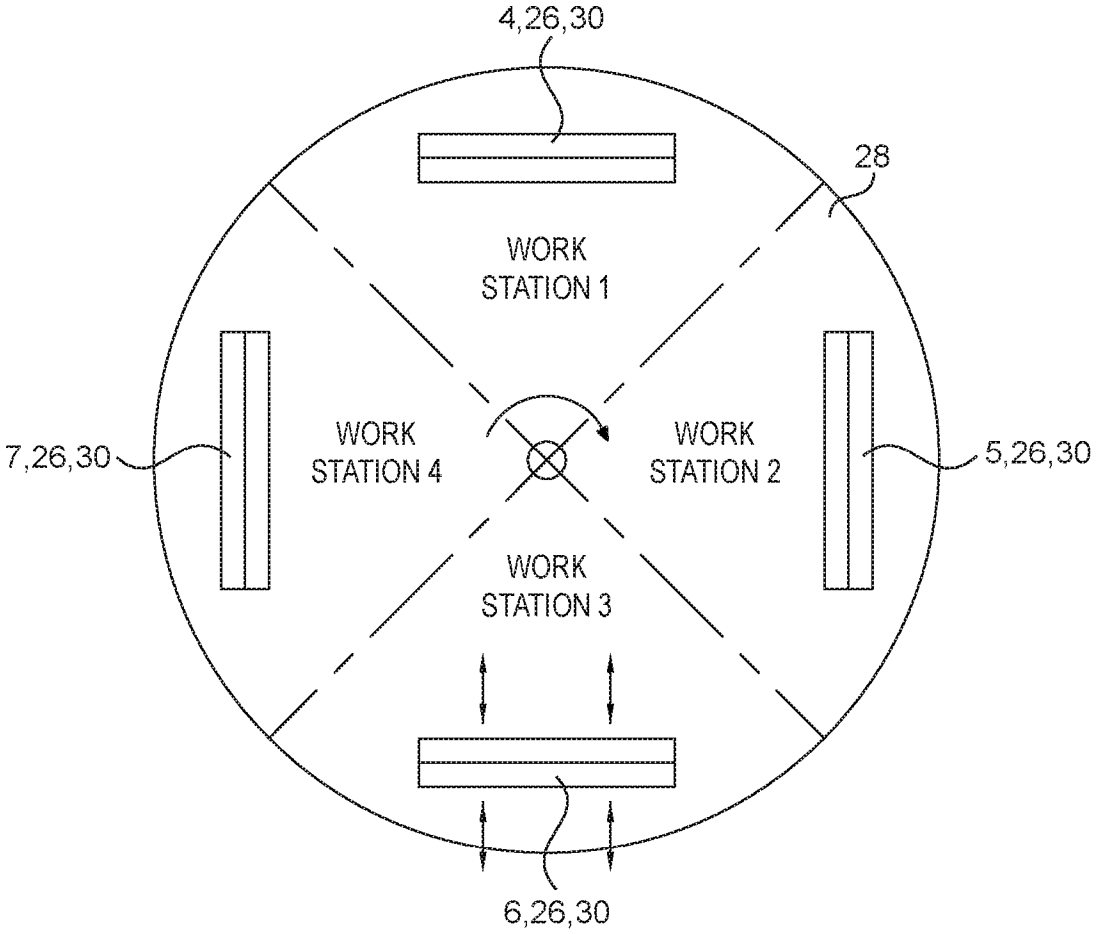

FIG. 7 shows a plan view of a turntable of the moulding apparatus of FIG. 1 provided with multiple mould blocks, each mould block being at a different stage of the process.

Figure 8:
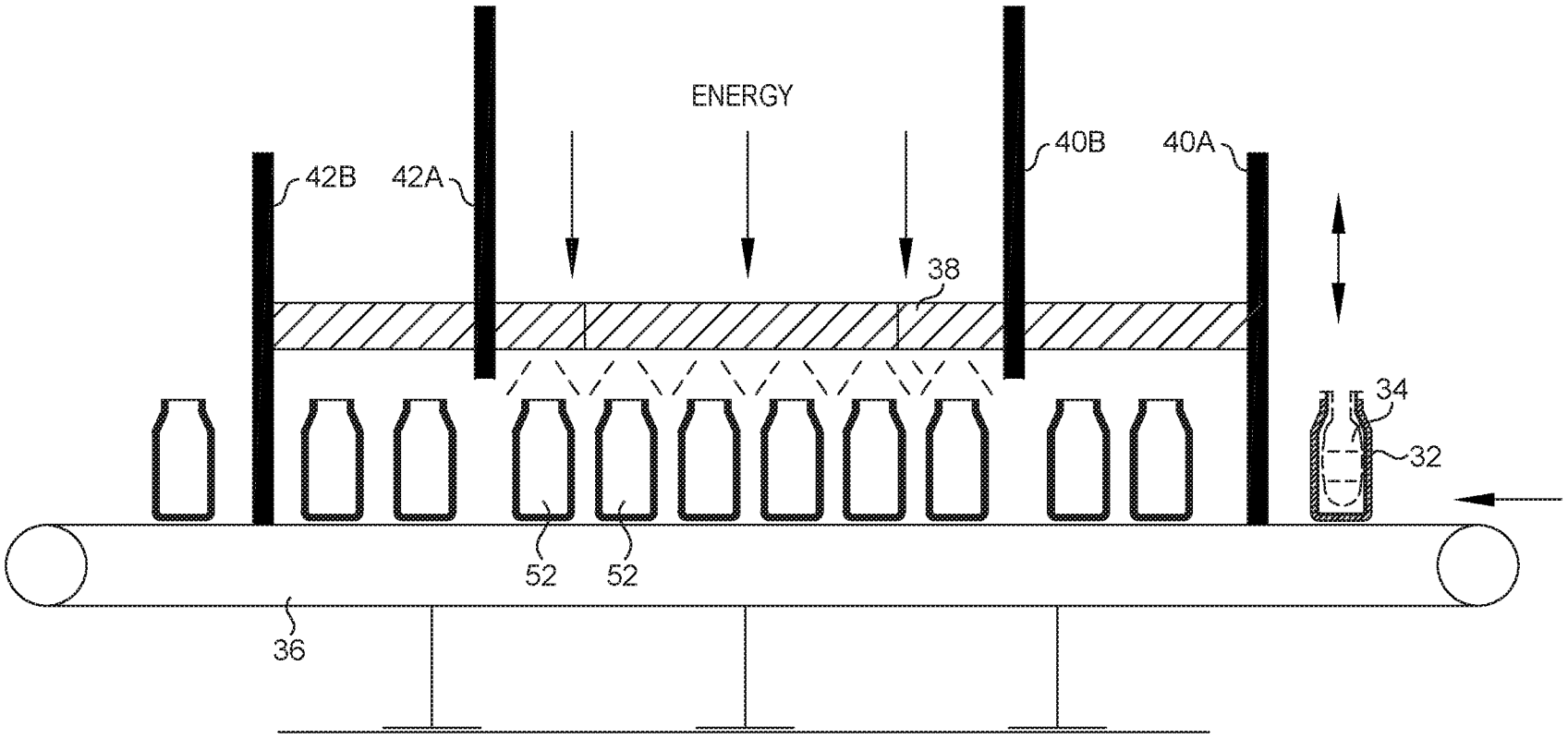

FIG. 8 shows a cross-sectional view of the microwave drying chamber of the moulding apparatus of FIG. 1.

Figure 9:
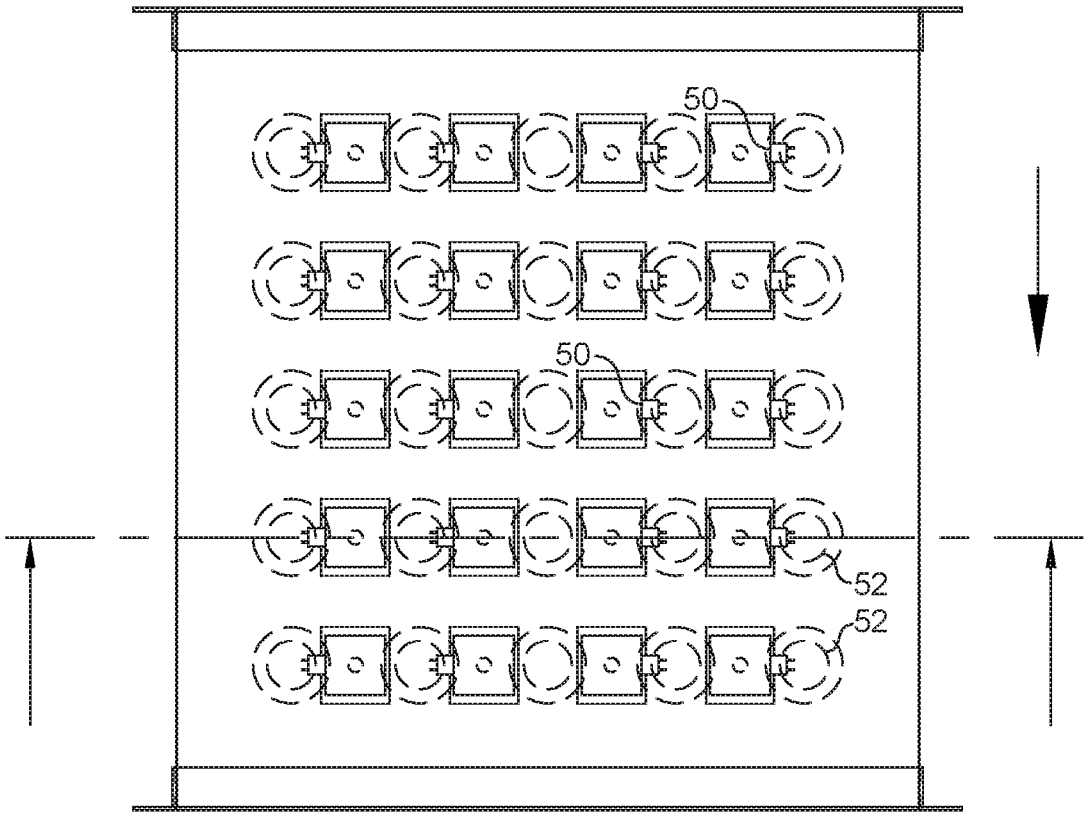
Figure 9:
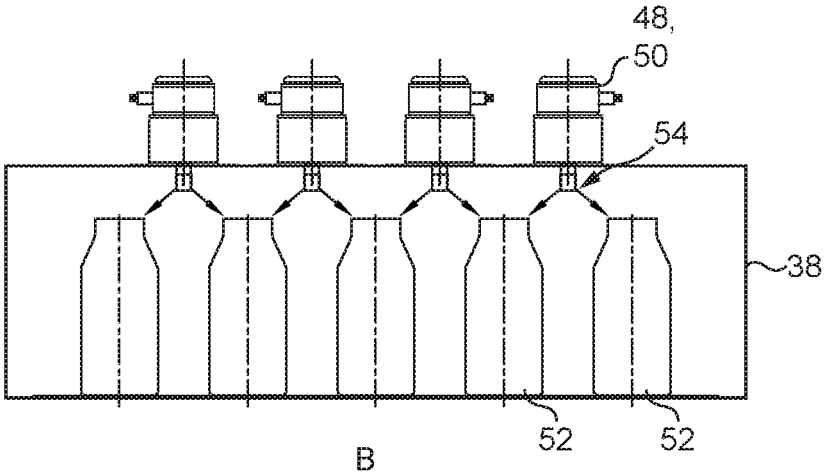

FIG. 9 shows details of the arrangement of magnetrons in the microwave drying chamber of FIG. 8: FIG. 9(*a*) shows a plan view of the microwave drying chamber including the magnetron array; FIG. 9(*b*) shows a cross section through the microwave drying chamber on line A-A in FIG. 9(*a*).

Figure 10:
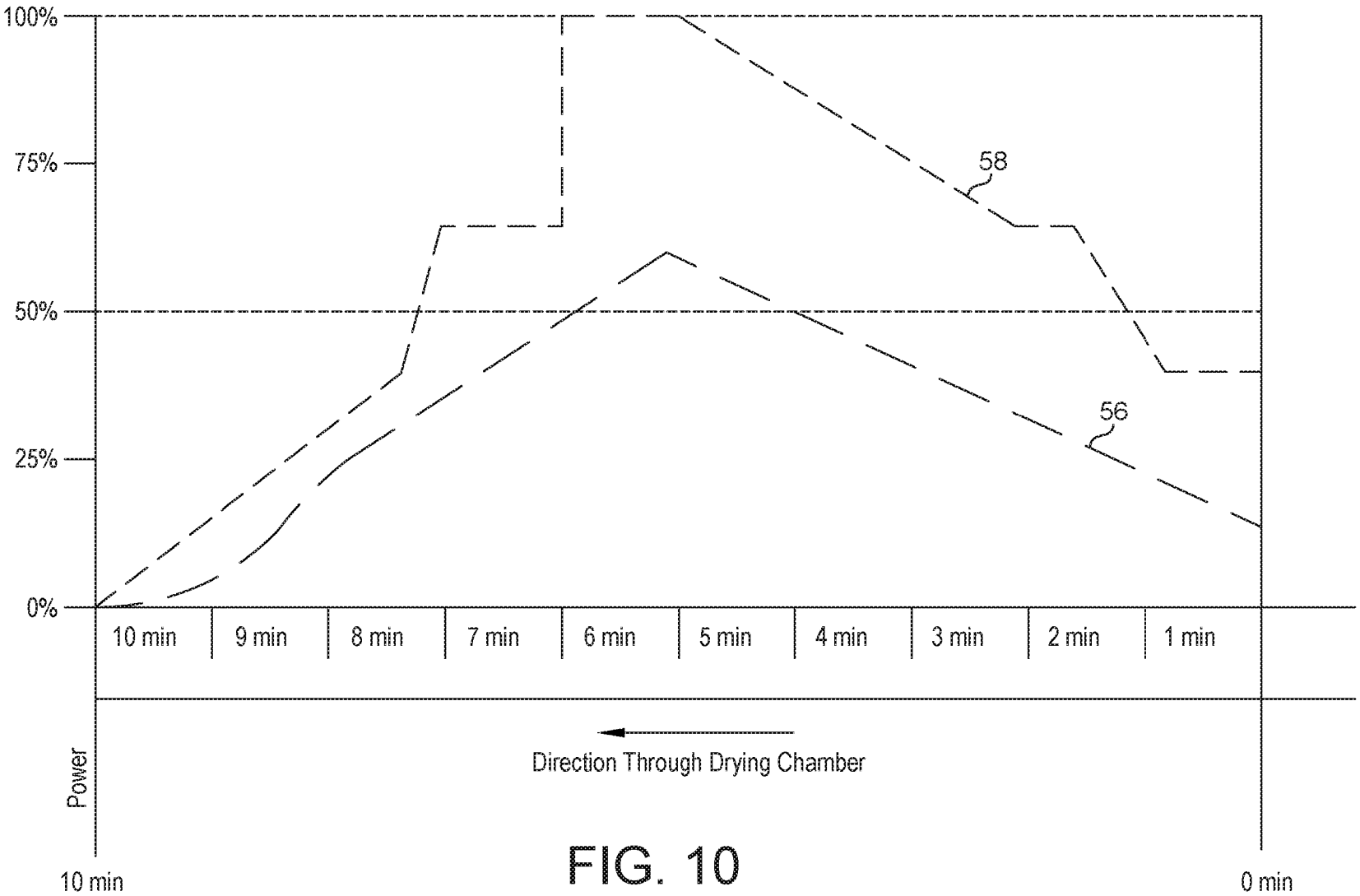

FIG. 10 is a graph of magnetron power vs. position in the microwave drying chamber (as measured by the length of time a moulded article has spent in the microwave drying chamber before it reaches the magnetron position) of FIG. 9, showing power levels for different magnetrons of the array for two different product weights.

Figure 11A:
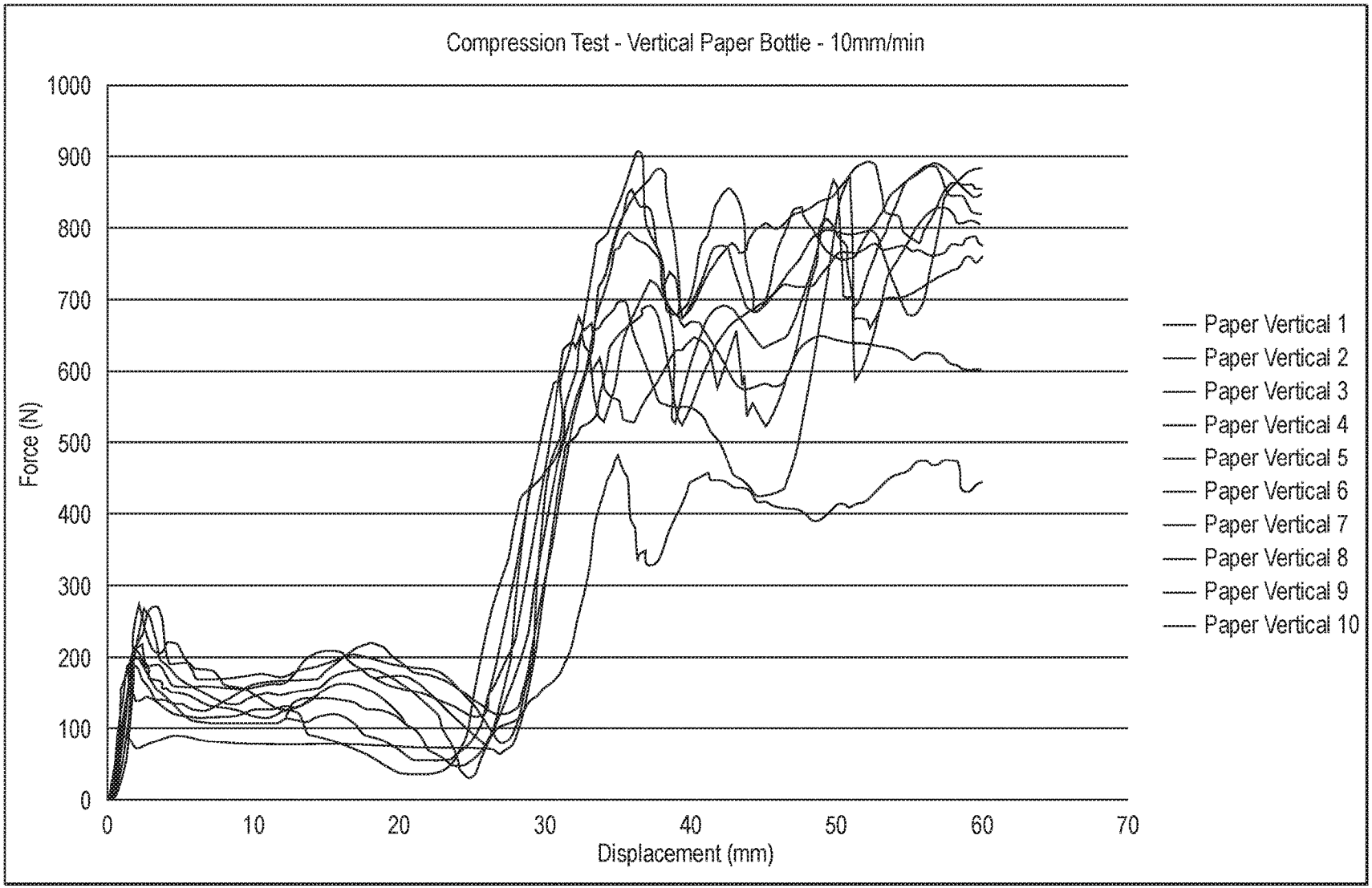
Figure 11B:
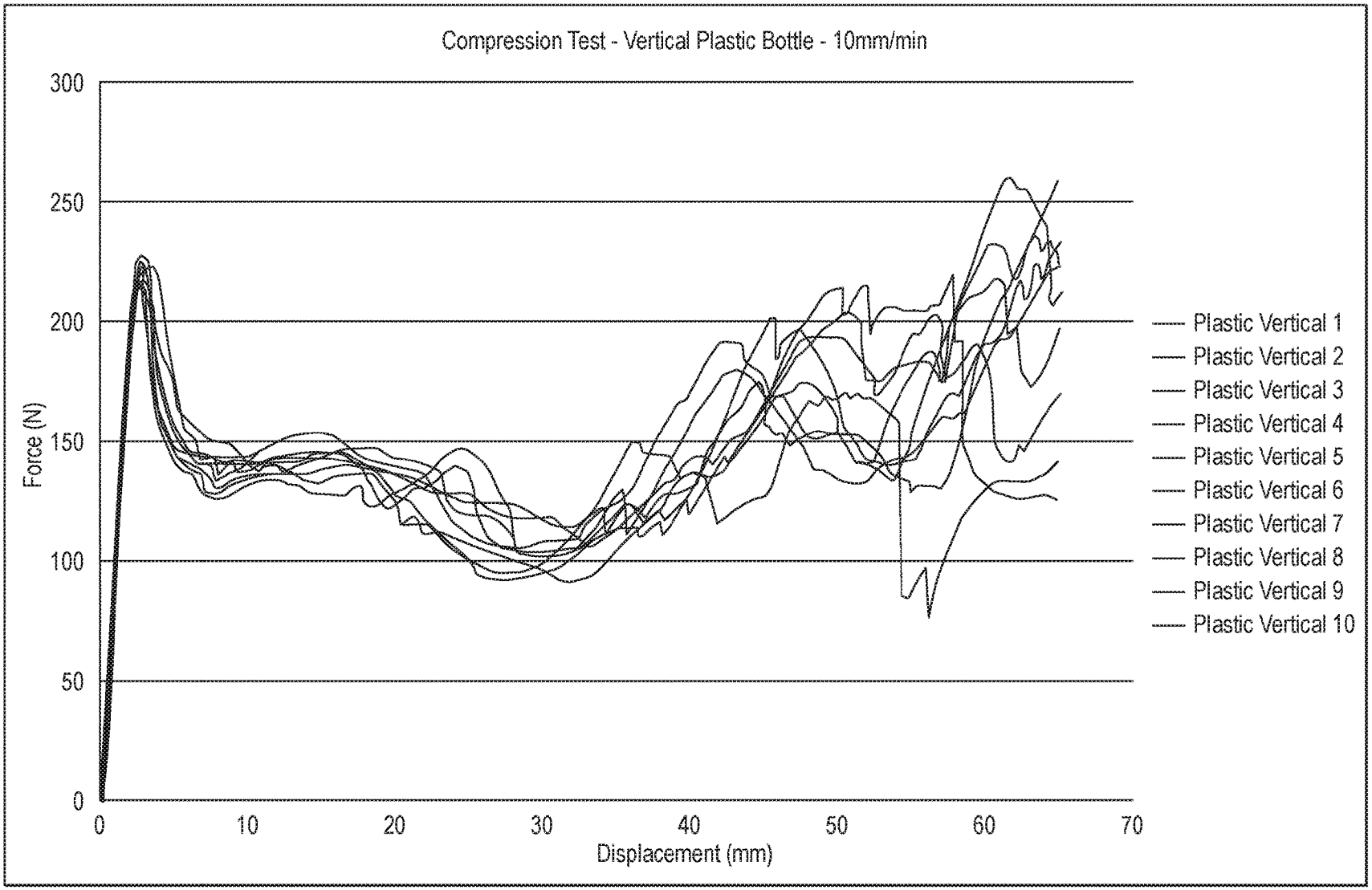

FIG. 11 shows the results (graph of force in N against displacement in mm) of vertical compression tests carried out on (a) 5 moulded bottles formed using the process of the preferred embodiment of the invention and (b) 5 plastics bottles for comparison.

Figure 12A:
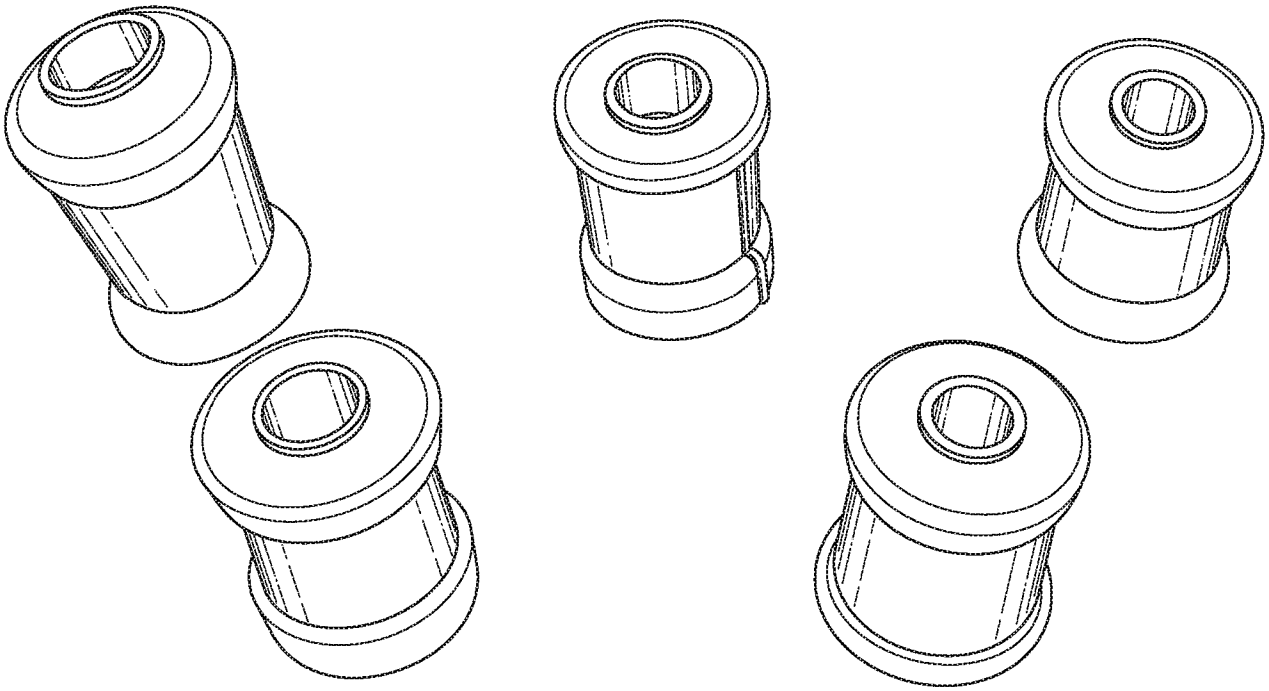
Figure 12B:
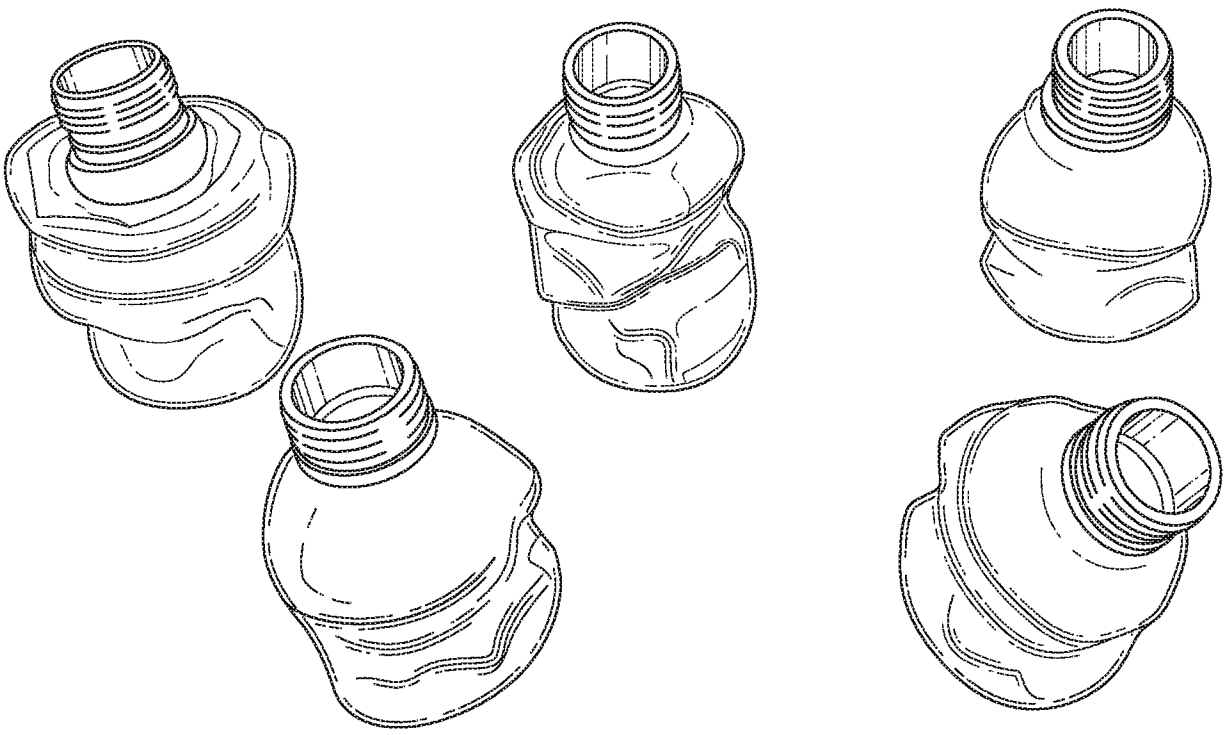

FIG. 12 shows the moulded bottles (a) and plastics bottles (b) of FIG. 11 after the vertical compression tests.

OVERVIEW OF MACHINE ARCHITECTURE

Figure 2:
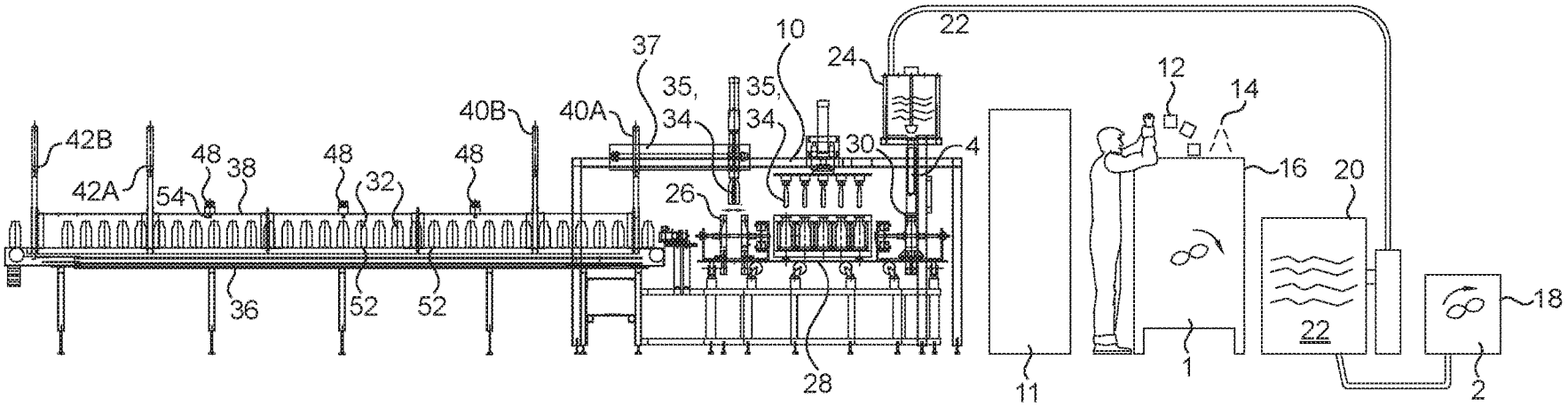
FIG. 2 shows a side view of the moulding apparatus of FIG. 1.

The moulding apparatus (FIGS. 1 and 2) is fully automated to carry out the following steps shown in FIGS. 3-8:

high shear mixing of water and recycled paper (1)
second stage mixing of feedstock (2)
filling of moulds with feedstock (4)
dewatering/forming of moulded articles (5)
demoulding of moulded articles (6)
mould preparation (7)
drying of moulded articles (8)

Figure 3:
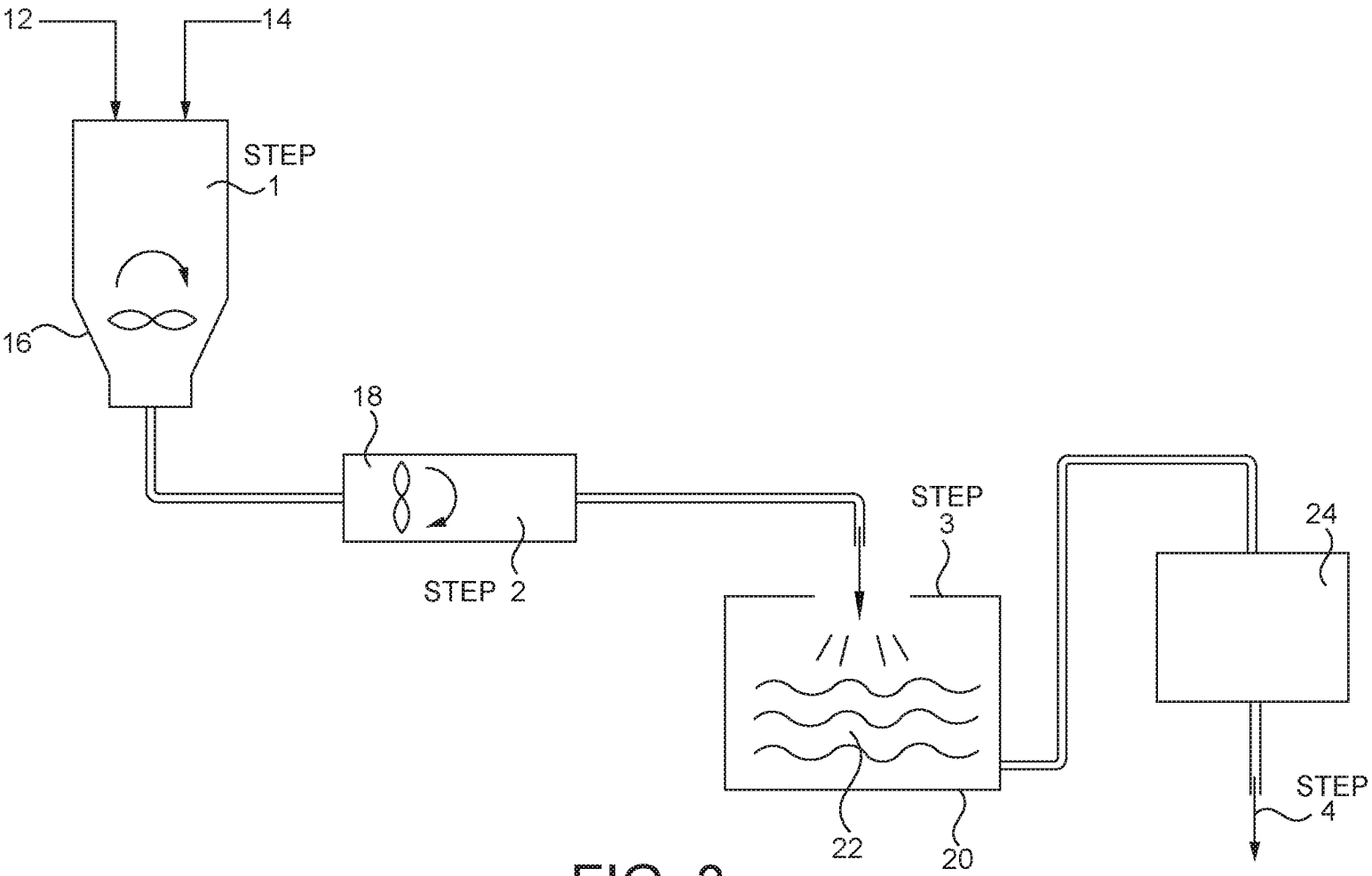
FIG. 3 shows a cross-sectional view of the part of the moulding apparatus of FIG. 1 used to prepare the fibre suspension.
Figure 4:
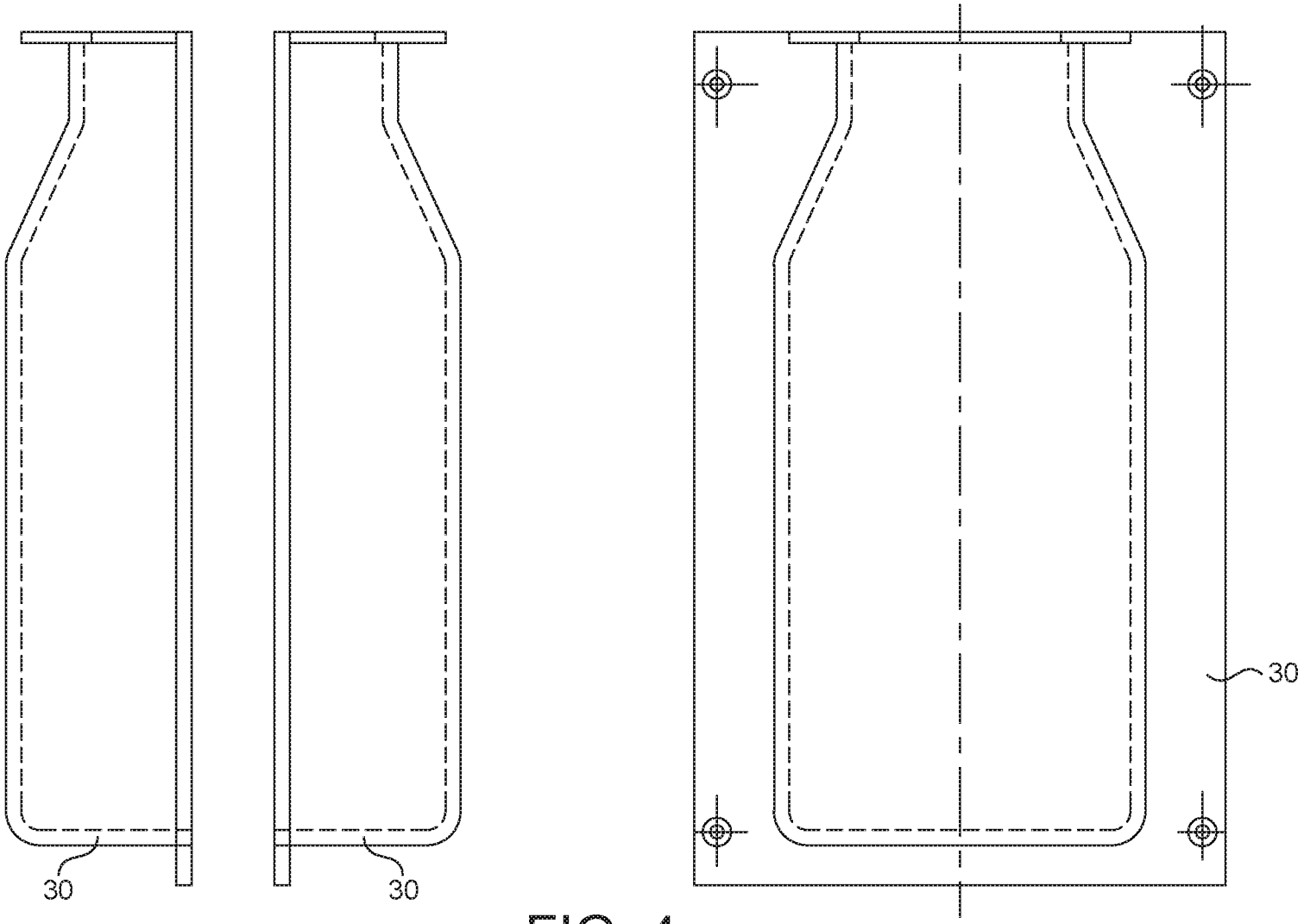
FIG. 4 shows a cross-sectional view of the mould parts of the apparatus of FIG. 1.

Water-fibre suspension (feedstock) is prepared from water and recycled paper as explained in detail below (FIG. 3). The feedstock 22 supplies an automated multiple mould block 26 mounted on a turntable 28 (step 4 in FIGS. 6(*a*) and 7). There are four work stations (not shown), situated at 90 degree intervals around the turntable. A mould block 26 is situated at each work station. There are 4 moulds in a row per mould block 26, and each mould block 26 is formed in two symmetrical parts 30 (FIG. 6(*c*)) enabling it to automatically open and close as required to extract the moulded article 32. Once the feedstock 22 has been deposited in the moulds 26 (step 4 in FIGS. 6(*a*) and 7), the turntable 28 rotates 90 degrees, presenting the moulds 26 to the next workstation, at which point inflatable bladders 34 are introduced into the moulds 26 (step 5 in FIGS. 6(*b*) and 7). The bladders 34 are then inflated. The moulds 26 are opened and the articles 32 are transported on the bladders 34 as the turntable 28 rotates another 90 degrees (step 6 in FIGS. 6(*c*) and 7). The pressurising fluid is then removed from the bladders 34 and the moulded articles 32 are removed and transferred to a conveyor belt 36 (FIG. 8). The turntable 28 then rotates a fourth time to the point where mould preparation (step 7 in FIG. 3) is performed, ready for the next batch. The conveyor belt 36 enters the microwave drying chamber 38 (FIG. 8) for drying to produce the finished moulded articles 32. The process is controlled via control means 11 which includes a programmable logic controller.

Preparation of Feedstock (Steps 1 and 2)

The feedstock is prepared from recycled paper 12 (the fibrous material) and water 14 (the suspending liquid) (FIGS. 1-3) which are introduced separately into the first high shear mixer 16. This feeds a smaller second-stage high shear mixer 18 to further pulp the material.

The process employs commercially available (e.g. from Maelstrom or Silverson) compact high shear mixer/homogenisers 16, 18 each having a rotor/stator arrangement (not shown). Silverson BE450™ (operating at 3000 rpm) is suitable. A high shear liquidisation head is used which avoids blocking. This converts the shredded paper fibre into a low concentration suspension (1-3 wt %) of paper fibre in water.

The feedstock 22 is fed under pressure by the second mixer 18 to a storage tank 20. The feedstock 22 is then delivered under pressure by a pneumatic diaphragm pump to a header tank 24 on demand to supply the mould block 26 as explained in detail below.

Introduction of Feedstock into Mould (Step 4)

Figure 5:
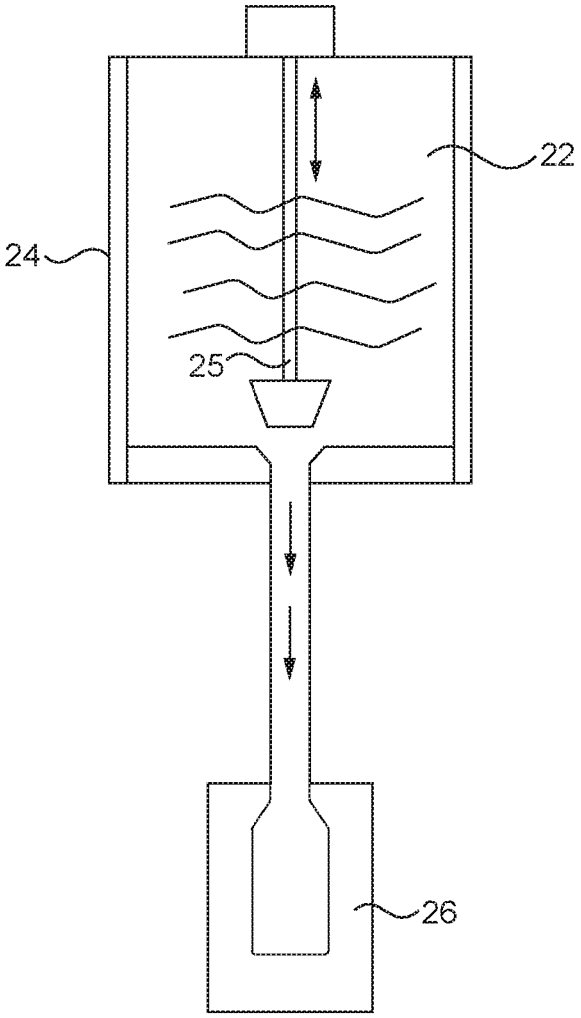
FIG. 5 shows a cross-sectional view of the part of the moulding apparatus of FIG. 1 used to charge the mould.

Each mould block 26 is made as a porous filter constructed of bonded particles. Such moulds are commercially available for example from from Aegis Advanced Materials (porous sintered bronze), www.sintermesh.com and www.porvairfiltration.com (Sinterflo™ P sintered porous bronze). As explained above, each mould block 26 is formed of two separable parts 30 (FIG. 4) which together form 5 cavities each defining the outside surface of one moulded article 32 in the form of a bottle with a neck. The feedstock 22 is introduced into each cavity of the mould block 26 (FIG. 6(*a*)) using fill control 25 which is in the form of a plug valve controlled by a rod (FIG. 5). Positive head pressure is used to charge the moulds 26, with water being drawn through pores 44 of the mould 26 using suction, depositing a layer of paper pulp 46 uniformly on the inside (FIGS. 6(*a*),(*b*)). During this process water is removed leaving a moulded article (bottle) 32 formed of the layer of paper pulp 46 and containing around 75% water by weight. The water may be recycled via a micromesh inline filter.

Dewatering of the Product Using a Bladder (Step 5)

A profiled bladder 34 of polychloroprene rubber BS2752 C2 45 IRHD (thickness 0.65-1.0 mm) (also referred to herein as a "resilient flexible impermeable membrane") is introduced inside the mould 26 and is then inflated pneumatically (i.e. pressure is applied behind the membrane) using compressed air 35 at a pressure of 1-10 bar (100 kPa-1 MPa) gauge for 15-30 seconds (FIG. 6(*b*)). Suction is applied at the same time. This presses the bottle 32 against the mould 26 so that water is expressed from the bottle 32 through the pores 44 and the internal surface of the bottle 32 is smoothed.

Demoulding (Step 6)

The mould block 26 is automatically opened by separating the two mould parts 30 and the bottle 32 is removed, remaining supported on the bladder 34 (FIG. 6(*c*)). The bottle 32 at this stage is very fragile so that the bladder pressure has to be carefully controlled to achieve mould release without distortion or damage. An internal bladder pressure of 1.1 bar (1.11 kPa) gauge has been found to be suitable. The bottle 32 is then transferred using the bladder 34 to a conveyor belt 36 (FIG. 8) and released from the bladder 34 to be passed to the drying stage. The pressurising fluid is evacuated causing the bladder 34 to deflate allowing for its removal from the bottle 32.

Microwave Drying (Step 8)

The bottle 32 is then conveyed on the conveyor belt 36 through a microwave drying chamber 38 in the form of a tunnel (FIG. 8). The conveyor belt 36 is in the form of a permeable lattice to assist water evaporation. The bottles 32 are exposed to multiple direct microwave sources (magnetrons) 48 to achieve efficient drying as described in more detail below. Airflow is maintained through the microwave drying chamber 38 in order to extract evaporated water vapour, and to ensure that the magnetrons 48 are kept suitably cool.

The microwave drying chamber 38 includes entrance and exit airlocks 40, 42, each including a pair of doors A, B operated in synchronisation so that they are not open at the same time. This allows continuous operation while ensuring no leakage of microwave energy outside the chamber. The entrance/loading airlock 40 is activated and signals conveyor belt 36 to advance and the bottles 32 are transported into the airlock chamber. A signal stops the conveyor belt 36 and reverses the action of the airlock 40. This procedure is repeated at the exit to the drying chamber 38, with activation of the exit/unloading airlock 42 allowing the bottles to exit the microwave drying chamber 38.

As will be appreciated, microwave energy is focused upon the water contained in the bottles 32 and is therefore not wasted in heating the surrounding air or equipment. An array 50 of multiple domestic grade magnetrons 48 (power rating 1 kW) mounted to the upper wall of the microwave drying chamber 38 is used (FIG. 9). As shown in FIG. 9(*a*), a rectangular 5 (in direction of travel)×4 (widthwise) grid arrangement of evenly spaced magnetrons 48 is used as the array 50 in this preferred embodiment. The magnetron antennae 54 are used to direct the radiation field into the microwave drying chamber 38 without conventional wave guides.

Each magnetron 48 of the array 50 is fitted with an individual power control (not shown) such that the power output can be controlled and switched on/off for individual magnetrons 48 or for the array 50 as a whole. This allows for power profiling along the microwave drying chamber 38 (FIG. 10) which can be adjusted to suit different products. Automatic control is used.

The bottles 32 are arranged upright in an array 52 (shown in plan view in FIG. 9(*a*) and in section in FIGS. 8 and 9(*b*)) which is complementary to the array 50 of magnetrons 48. A rectangular 5×5 grid arrangement of evenly spaced bottles 32 having the same centre-to-centre spacing as the magnetrons 48 is used such that bottles 32 and magnetrons 48 alternate across the width of the chamber (FIG. 9(*a*)). Bottles 32 are passed through the microwave drying chamber 38 in batches.

As examples, power profiles 56, 58 for bottles 32 weighing 120 g and 200 g respectively are shown in FIG. 10 (capacities 100 mL and 750 mL respectively). As bottles 32 pass along the microwave drying chamber 38 over a 10 minute period in FIG. 10, they will pass different magnetrons 48 within the array 50, operating at different powers.

This final stage reduces the water content of the bottle to below 10%.

Test Results

Compression tests were carried out on vertically orientated 200 mL paper bottles (i.e. moulded articles of the preferred embodiment of the invention) and 200 mL PET plastic bottles at a compression rate of 10 mm/minute.

Force displacement plots are shown in FIG. 11 and pictures of the bottles after testing are shown in FIG. 12. In general, the paper bottles required a higher force to yield (400-900 N rather than 100-250 N). The paper bottles yielded by inversion of the neck into the body of the bottle, whereas the plastics bottles yielded by crumpling of the body. As deformation of the paper bottles continued, the load increased as inversion continued until the neck was level with the main body (FIG. 12).

Advantages of Preferred Embodiment

In addition to the advantages mentioned above, these include:

- environmentally friendly paper packaging products are produced using post-consumer recyclable materials.
- The process is optimised for energy conservation by eliminating or reducing the three main elements which contribute to excessive use of energy normally required with conventional pulp moulding processes. These are (a) the use of a hydropulper (eliminated), (b) vacuum (reduced), and (c) drying ovens (eliminated).
- the products can be manufactured to a high degree of precision and complexity that is difficult to achieve with existing techniques.
- the process can produce a high volume of product throughput whilst retaining portable, miniaturized and operationally flexible plant machinery. For example, a machine with a foot print of 10 square metres has a production capacity of 8 million bottles per year.
- the product bottle has a high crush strength, higher than PET.

These design elements result in a significant saving on equipment cost as well as a high energy delivery efficiency. Apparatus of the general type of the preferred embodiment can be used to make well-formed containers of widely different shapes tailor-made to the customer's requirements.

Although the invention has been described with reference to the preferred embodiment shown in the figures, the skilled person will understand that various modifications are possible within the scope of the invention.

The invention claimed is:

1. A method of forming a moulded article comprising:

preparing a fiber suspension by liquidising fibrous material in a suspending liquid using at least one high shear mixer, wherein the fibrous material is selected from the group consisting of: virgin paper fiber, recycled paper fiber, bamboo fiber and flax fiber, wherein suspended fibers have a length of 0.75 mm to 1.8 mm, and wherein the high shear mixer(s) comprises one or more rotors rotating at 1000-4000 rpm;

feeding the fiber suspension to a moulding surface of a porous mould, the porous mold having pores with a diameter of 0.3 mm to 0.6 mm; removing said suspending liquid via pores of said porous mould to deposit the suspended fibers on said mould surface as a moulded article, the step of removing said suspending liquid comprising pressing a bladder formed of a resilient flexible impermeable membrane against the article using pressure applied behind the membrane;

removing the moulded article from the porous mould; and drying the moulded article using microwave radiation generated using at least one magnetron.

2. A method as claimed in claim 1, wherein the moulded article is a three-dimensional hollow form.

3. A method of forming a moulded article as claimed in claim 1, wherein the at least one magnetron operates at a power rating of less than 5 kW.

4. A method as claimed in claim 1, comprising using a plurality of magnetrons arranged in an array.

5. A method as claimed in claim 4, wherein the plurality of magnetrons have individually controllable power outputs.

6. A method as claimed in claim 1, wherein the microwave radiation is transmitted from the magnetron(s) to the moulded article, and wherein the magnetron is free of a waveguide.

7. A method as claimed in claim 1, wherein the bladder is used to transport the moulded article from the porous mould for drying.

8. A method as claimed claim 1, comprising drying the moulded article free of use of hot air or infrared radiation.

9. A method as claimed in claim 1 wherein no drying takes place in the porous mould.

10. A method as claimed in claim 1, wherein the fiber suspension is prepared in two stages using a first high shear mixer followed by a second high shear mixer.

11. A method as claimed in claim 1, wherein the at least one or more rotors rotate at about 3000 rpm.

12. A method as claimed in claim 1, wherein the high shear mixer(s) further comprises a stator, and the rotors rotate within the stator.

13. A method as claimed in claim 1, wherein the porous mould is formed of bonded particles and/or is formed using an additive manufacturing technique.

14. A method as claimed in claim 1, wherein the fibrous material comprises paper.

15. The method as claimed in claim 10, wherein the first high shear mixer and the second high shear mixer are combined in a unit having a length of 0.5-1.0 meter.

* * * * *